United States Patent [19]

Torii

[11] 4,362,018

[45] Dec. 7, 1982

[54] HYDRAULIC ROTATION CONTROL CIRCUIT

[75] Inventor: Satoru Torii, Akashi, Japan

[73] Assignee: Kobe Steel, Ltd., Kobe, Japan

[21] Appl. No.: 158,877

[22] Filed: Jun. 12, 1980

[51] Int. Cl.[3] ..... F15B 13/042

[52] U.S. Cl. ..... 60/468; 60/493; 91/436; 91/457

[58] Field of Search ..... 91/436, 454, 457; 137/596.15; 60/468, 493

[56] References Cited

U.S. PATENT DOCUMENTS

| | | | |
|---|---|---|---|
| 2,569,881 | 10/1951 | Davies | 91/454 |
| 2,583,185 | 1/1952 | McLeod | 137/596.15 |
| 3,080,887 | 3/1963 | Brandenberg | 91/454 X |
| 3,654,836 | 4/1972 | Schexnayder | 137/596.15 X |
| 3,841,345 | 10/1974 | Cryder | 137/596.15 X |
| 3,954,046 | 5/1976 | Stillhard | 91/457 X |
| 4,231,396 | 11/1980 | Budzich | 137/596.13 |

FOREIGN PATENT DOCUMENTS

| | | | |
|---|---|---|---|
| 2437513 | 4/1980 | France | 137/596.15 |

*Primary Examiner*—Irwin C. Cohen
*Attorney, Agent, or Firm*—Oblon, Fisher, Spivak, McClelland & Maier

[57] ABSTRACT

A hydraulic rotation control circuit for a rotational actuator such as a hydraulic motor for rotating a rotary frame of a hydraulic crane, the circuit employing a combination of a number of check and variable reducing valves in a manner which allows smooth and delicate control of the rotation of the actuator to provide an operation performance equivalent to that of mechanical drive, including coasting operation of the motor.

1 Claim, 1 Drawing Figure

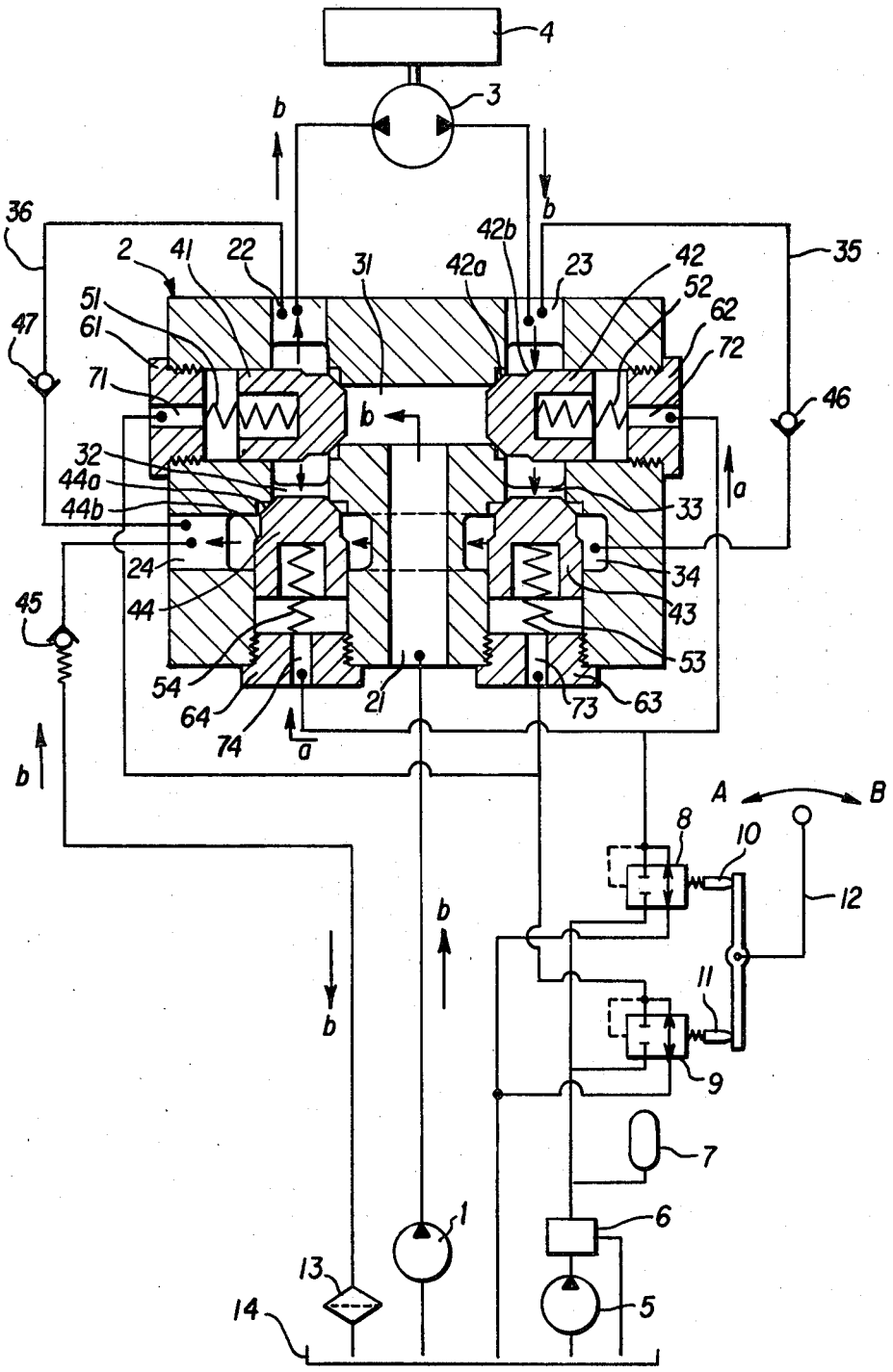
4
3
b
b
36
35
2
41
22
31
42b
42a
23
42
52
62
72
51
61
71
47
46
b
32
44a
44b
33
a
24
34
44
43
45
53
54
64
74
a
21
73
63
b
A
B
8
10
12
b
b
11
9
7
1
6
13
5
14

HYDRAULIC ROTATION CONTROL CIRCUIT

BACKGROUND OF THE INVENTION

1. Field of the Invention

This invention relates to a hydraulic control circuit for an actuator such as a hydraulic motor for rotating a rotary frame of a crane.

2. Description of the Prior Art

In conventional hydraulic control circuits, the operation of an actuator is generally controlled by regulating the flow of operating fluid with use of a plunger type change-over valve. This sort of change-over valve has inferior flow characteristics over the plunger stroke, adversely affected by load pressures, and it therefore has been difficult to effect delicate control of the rotational speed of the actuator.

Similar change-over valves have also been used in hydraulic control circuits for controlling rotation of hydraulic cranes and changing the direction and speed of rotation of a hydraulic drive motor by the change-over valve. In some cases, the control circuit is provided with a pressure compensating control valve for preventing the above-mentioned variations in the flow characteristics due to load pressures. However, the provision of such a control valve neither changes the flow characteristics themselves nor allows for delicate control of the rotational speed.

There have been proposed various other control circuits incorporating a brake valve, a relief valve, a pressure control valve or a flow control valve for preventing cavitation, shocks or overloading in rotational operations. The incorporation of these valves is, due to an increased number of component parts, reflected by a complicated circuit arrangement and a high production cost and on the contrary impairs the performance quality of the rotating body.

Particularly, as compared with the rotation by mechanical drive, it is difficult in hydraulic cranes to control the rotational speed of the hydraulic motor for the reasons stated above and due to variations in speed accruing from fluctuations in engine rotation, experiencing shocks at the time of starting or stopping the motor. Another problem experienced in hydraulic cranes is difficulty in controlling the braking force.

SUMMARY OF THE INVENTION

It is therefore an object of the present invention to provide a hydraulic rotation control circuit which overcomes the above-mentioned difficulties and problems.

A more particular object of the present invention is to provide a hydraulic rotation control circuit which allows delicate control of the rotation of an actuator.

Another object of the invention is to provide a hydraulic rotation control circuit which is simple in construction and which can be produced at a low cost.

A further object of the invention is to provide a hydraulic rotation control circuit which can provide performance similar to that of mechanical drive when applied for the control of rotation of a hydraulic crane.

According to the present invention, there is provided a hydraulic rotation control circuit for a rotary body, including in combination: first to fourth ports; first to fourth passages; a first check valve communicating the second port with the second passage and allowing fluid flows from the first passage to the second port and passage; a second check valve communicating the third port with the third passage and allowing fluid flows from the first passage to the third port and passage; a third check valve allowing fluid flows from the third passage to the fourth passage; a fourth check valve communicating the fourth port with the fourth passage and allowing fluid flows from the second passage to the fourth port and passage; a first variable reducing valve communicating with the second and fourth check valves and producing a variable pressure for controlling the blocking force of the second and fourth check valves against the first and second passages, respectively; a second variable reducing valve communicating with the first and third check valves and producing a variable pressure for controlling the blocking force of the first and third check valves against the first and third passages, respectively; a pump connected to the first port communicating with the first passage; a pump delivering a pressurized fluid to the first and second variable reducing valves; and an actuator connected to the second and third ports and operable to rotate the rotary body.

The above and other objects, features and advantages of the invention will become apparent from the following description and the appended claims, taken in conjunction with the accompanying drawing which shows by way of example a preferred embodiment of the invention.

BRIEF DESCRIPTION OF THE DRAWING

In the accompanying drawing:

The sole FIGURE is a diagram of a hydraulic rotation control circuit embodying the present invention.

DESCRIPTION OF PREFERRED EMBODIMENT

Referring to the accompanying drawing, there is shown a hydraulic rotation control circuit according to the invention, including a pump 1, a control valve 2, a motor 3, a rotary body 4, a pump 5, an unload valve 6, an accumulator 7, a first variable reducing valve 8, a second variable reducing valve 9, an operating lever 12, a filter 13 and a fluid storage tank 14. Reference numerals 10 and 11 denote rods of the reducing valves 8 and 9, respectively.

The pump 1 is a main pump for operating an actuator, in the particular example shown, the hydraulic motor 3 which is employed for turning a rotary body 4, more particularly, a rotary frame of a hydraulic crane. The control valve 2 is provided with four ports 21 to 24, four passages 31 to 34 and four check valves 41 to 44 in its casing. The first port 21 communicates with the main pump 1, the second and third ports 22 and 23 communicate with the output port of the motor 3, and the fourth port 24 communicates with a return passage to the tank 14.

The first check valve 41 is provided at the intersection of the first passage 31, leading from the first port 21, with the second port 22 and second passage 32, constantly communicating the second port 22 with the second passage 32 while resiliently closing with a spring 51 the open left end of the first passage 31, as seen in the drawing, to allow fluid flows from the first passage to the second port 22 and the second passage 32. The second check valve 42 is provided at the intersection of the first passage 31 with the third port 23 and the third passage 33, constantly communicating the third port 23 with the third passage 33 while closing with a spring 52 the open right end of the first passage 31, as seen in the drawing, to allow fluid flows from the first passage 31 to the third port 23 and the third passage 33.

The third check valve 43 is provided at the intersection of the third passage 33 with the fourth passage 34, resiliently closing the open lower end of the third passage 33 by a spring 53 to allow fluid flows from the third passage 33 to the fourth passage 34. The fourth check valve 44 is provided at the intersection of the second passage 32 with the fourth port 24 and the fourth passage 34, constantly communicating the fourth port 24 with the fourth passage 34 while resiliently closing the open lower end of the second passage 32 by a spring 54 to allow fluid flows from the second passage 32 to the fourth port 24 and the fourth passage 34.

Further, plugs 61 to 64 which are located behind the check valves 41 to 44 are provided with pilot ports 71 to 74, respectively, to admit pressurized fluid therethrough for the purpose of controlling the contacting or closing forces of the respective valves with the associated passages. The second and fourth pilot ports 72 and 74 are communicated with the secondary side of the first variable reducing valve 8, while the first and third pilot ports 71 and 73 are communicated with the secondary side of the second variable reducing valve 9. The pressure on the primary side of the first and second variable valves 8 and 9 are maintained at a predetermined level by the pump 5, unload valve 6 and accumulator 7 but the pressure on the secondary side is variable linearly from a zero value in proportion of displacement of the push-in rods 10 and 11 which are operated by the lever 12.

A fifth check valve 45 is provided at a half-way position of the return passage to the tank 14. The fourth passage 34 and the port 23 are communicated with each other by way of an auxiliary passage 35 which is provided with a sixth check valve 46. Ports 22 and 24 are also communicated with each other by way of a first auxiliary passage 36 which is provided with a seventh check valve 47. The fifth check valve 45, auxiliary passage 35, sixth check valve 46, seventh check valve 47 and second auxiliary passage 36 may be incorporated into the casing of the control valve 2 but, if desired, may be omitted entirely.

With the above-described circuit arrangement, if the lever 12 is turned toward the direction of arrow A, the rod 10 of the first variable reducing valve 8 is pushed in to produce pressure on the secondary side. The pressurized fluid flows in the direction of arrow (a) toward and into the pilot ports 72 and 74 of the plugs 62 and 64. As a result, the second check valve 42 is pressed and locked against the open right end of the passage 31 to block communication of the passage 31 with the third port 23 and passage 33. In this instance, however, the third port 23 is in communication with the passage 33.Simultaneously, the fourth check valve 44 is pressed and locked against the open lower end of the passage 32 to block its communication with the fourth port 24 and passage 34. However, the fourth port 24 is in communication with the passage 34.

On the other hand, the first and third check valves 41 and 43 are in free state, that is to say, are free of application of any force thereto except the pressing force of the springs 51 and 53, so that the fluid delivered by the pump 1 flows in the direction of arrow (b) through the first port 21 and passage 31 and opens the first check valve 41 against the force of the spring 51. The pressurized fluid which has passed through the first check valve 41 is fed to the motor 3 through the second port 22 to rotate the motor 3 in a predetermined direction and the rotary body 4 which is connected to the motor 3.

The fluid returning from the motor 3 through the third port 23 passes about the locked second check valve 42 and flows into the passage 33, opening the third check valve 43 against the force of the spring 53 to flow into the passage 34. The fluid then passes around the locked fourth check valve 44 and via fourth port 24, fifth check valve 45 and filter 13 returns to the tank 14.

When turning the lever in the direction of arrow A, if the amount of displacement of the push-in rod 10 is reduced by tilting the lever 12 in the direction of arrow A to a smaller degree, the secondary pressure of the first variable reducing valve 8 is lowered, locking the second and fourth check valves 42 and 44 with a smaller pressure (locking force). In this instance, part of the pressurized fluid which is fed from the main pump 1 to the motor 3 via first check valve 41 and second port 22 is led to the fourth check valve 44 via the first check valve 41 and passage 32 to open and pass the check valve 44, the fluid which has passed the check valve 44 being returned to the tank 41 through the fourth port 24, or led to the second check valve 42 from the passage 31 to open and pass the same to join the fluid which has been returned to the passage 33 through the third port 23, returning to the tank via third check valve 43 and passage 34 and through the fourth port 24. Therefore, the pressure of the fluid which is fed to the motor 3 through the second port 22 is lowered to thereby rotate the motor 3 and rotary body 4 at a lower speed.

Thus, as the lever 12 is turned gradually in the direction of arrow A from a neutral position, the secondary pressure of the first variable reducing valve 8 is increased correspondingly to increase the fluid pressure acting on the second and fourth check valves 42 and 44, as a result the discharge pressure from the second port 22 is elevated accordingly to accelerate the rotation of the motor 3 and rotary body 4 smoothly.

In this instance, if the passages 31 and 32 are same in sectional area and the check valves 42 and 44 are the same, the pressure of the second port 22 is of a constant level as obtained by multiplying the secondary pressure of the first variable reducing valve by a ratio of the area of the fourth check valve on the side of the plug 64 to the area of the passage 32 or by a ratio of the area of the second check valve 42 on the side of the plug 62 to the area of the passage 31, so that the motor 3 accelerates the rotation of the rotary body 4 constantly with a predetermined torque. Namely, the driving pressure of the motor 3 remains at a predetermined level according to the angle of the operating lever 12 until the fluid delivered from the main pump 1 is entirely admitted into the port 22.

Therefore, when the operating lever 12 is turned in the direction of arrow A, it is possible to adjust the pressure to be supplied to the motor 3 from the second port 22 by varying the angle of the lever 12. It follows that the rotational speed, acceleration and accelerating time of the motor 3 and thus of the rotary body 4 can be freely controlled by way of the operating lever 12.

Now, if the lever 12 is returned to the neutral position, the secondary pressure of the first variable reducing valve 8 is passed therethrough and released toward the tank 14. As a result, the second and fourth check valves 42 and 44 are brought into a free state, that is to say, relieved of any restrictions except the pressing forces of the springs 52 and 54. At this time, the first and third check valves 41 and 43 are continually held in a free state. Therefore, the motor 3 continues its rotation under the influence of the inertial force of the rotary body 4 to allow for a so-called "coasting operation", for example, when turning a crane.

More particularly, since all of the first to fourth check valves 41 to 44 become free, part of the fluid which is fed from the pump 1 to the first port 21 passes the first and fourth check valves 41 and 44 or the second and third check valves 42 and 43 and flows out through the fourth port 24 to return to the tank 14, while the remainder flows into the intake port of the motor 3 through the second port 22. The fluid pressure fed to the motor 3 from the second port 22 is not so high as to drive the motor 3 and no positive braking force acts at the exhaust port or on the return side of the motor 3. Therefore, the motor 3 continues its rotation by the inertial force of the rotary body 4.

In the above-mentioned "coasting operation" by the inertial force of the rotary body 4, pressure of a certain level is generated at the fourth port 24 by the fifth check valve 45 so that most of the fluid which is fed from the pump 1 past the first port 21, passage 31 and first check valve 41 flows into the intake port of the motor 3. As pressure is generated at the fourth port 24, pressure is also generated at the third port 23. Therefore, before the fourth or third check valve 44 or 43 is opened, the fluid returning from the coasting motor 3 acts on tapered surfaces 42*a* and 42*b* of the second check valve 42 and pushes back the latter to flow into the passage 31, the return fluid joining there with fluid fed from the main pump 1 to flow into the intake port of the motor 3 via first check valve 41. Thus, the motor continues smooth rotation without causing cavitation. Under these circumstances, excessive fluid is returned to the tank 14 via third or fourth check valve 43 or 44.

In order to stop the rotation of the motor 3 and the rotary body 4, the lever 12 is turned in the direction of arrow B for a so-called "reverse lever action", pushing in the rod 11 of the second variable reducing valve 9. As a result, the secondary pressure of the second variable reducing valve 9 is increased and presses the first and third check valves 41 and 43 to block the return fluid from the motor 3 for stopping its rotation.

In this instance, if the lever 12 is fully turned in the direction of arrow B by an abrupt operation to lock the first and third check valves completely, the fluid fed from the main pump 1 and the fluid returning from the motor 3 are completely blocked in the passages 31 and 33, abruptly increasing the pressure of the motor or pump circuit (main circuit). However, this pressure can be relieved by a setting mechanism for setting the maximum control pressure on the secondary side of the second variable reducing valve 9 at the level equivalent to the maximum rated pressure on the main circuit. By so doing, the first or third check valve 41 or 43 is opened at the preset value to relieve the fluid fed from the main pump 1 and the fluid returning from the motor 3. A similar relief is possible also for a sharp pressure increase which is caused to the main circuit due to the inertial force of the rotary body 4 when the lever 12 is abruptly manipulated for rotating the motor 3 and the rotary body 4.

In such a case, it is further necessary to supply supplemental fluid to the intake port of the motor 3 so as to prevent cavitation. The fluid which has been relieved by the first check valve 41 directly flows into the intake port of the motor 3, and the fluid which has been relieved by the third check valve 43 flows toward the fourth port 24 and, since the fifth check valve 45 generates pressure at the fourth port 24 which acts on the tapered surfaces 44*a* and 44*b* to open the fourth check valve 44 the fluid, 5 led to the first port 21 through the opened fourth check valve 44 and passage 32, thereby preventing cavitation of the motor 3. At this time, excessive fluid is returned to the tank 14 through the fifth check valve 45.

Thus, when the rotation is stopped by an abrupt lever action, the main circuit is relieved at the preset pressure level, decelerating and stopping the rotary body 4 in a short time period. However, in a deceleration condition where the lever 12 is turned halfway in the direction of arrow B, without being thrown full stroke, in order to increase the secondary pressure of the variable reducing valve 9 to a suitable selected level, the return fluid at the third port 23 can be controlled to a desired value by an operation inverse to that of acceleration which was described hereinbefore in connection with the starting operation and thus the deceleration or the time of deceleration of the rotary body 4 can be freely controlled.

If the lever 12 is returned to the neutral position as soon as the rotary body 4 is stopped, the latter is continually held at standstill. At this time, the secondary pressures of the variable reducing valves 8 and 9 are released to the tank 14 to free the respective check valves 41 to 44, and the fluid fed from the main pump 1 is via first and fourth check valves 41 and 44 or second and third check valves 42 and 43 and through the fourth port 24 and fifth check valve 45. If it is desired to rotate again the rotary body 4, this time in the opposite direction, the operating lever 12 is simply turned in the opposite direction.

With the foregoing circuit arrangement, in a case where the main pump 1 is driven by an engine, if the rotary body 4 is rotated at a maximum engine rotation with the lever 12 thrown full stroke in the direction of arrow A and the engine rotation is lowered leaving the lever 12 in the fully turned position, there occurs a tendency of generating a negative pressure at the intake port of the motor 3 now in coasting operation (or at the second port 22) due to a drop in the output of the pump 1. In such a case, cavitation of the motor 3 can be prevented by providing a seventh check valve 47 between the ports 22 and 24, letting the return fluid from the motor 3 pass through the check valve 47 to join the fluid from the pump 1 in the port 22 and flow into the motor 3 again. At this time, excessive fluid is returned to the tank 14 through the fifth check valve 45. The same operation applies to rotation in the opposite direction.

However, in this case, the check valve 46 operates to prevent the cavitation of the motor 3 wherein the fluid in the passage 34 is returned into the port 23 then into the motor 3. In the foregoing embodiment, fifth check valve 45 can be omitted as long as a pressure necessary for appropriate operation of the respective check valve is produced at the port 24 by fluid resistance in the passage between the port 24 and the tank 14.

It will be appreciated from the foregoing description that, according to the present invention employing a particular combination of a number of check valves and variable reducing valves, the start, stop, direction and speed of the operation of the actuator can be controlled in an extremely simplified manner by a single lever, while allowing the so-called coasting operation which has thus far been desired. In addition, it is possible to integrate the respective check valves into a single control valve to reduce the number of component parts and the production cost and to facilitate the assembling work and maintenance. Especially in a case where the control circuit of the invention is employed for controlling rotation of a hydraulic crane, such can provide a performance equivalent to that of mechanical drive, ensuring very smooth rotations.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A hydraulic rotation control circuit operating below a maximum pressure for rotating a rotary body under a driving pressure, comprising a control valve assembly including a first, second, third and fourth port and first, second, third and fourth passages formed in said assembly wherein the cross sectional areas of said first and second passages are equal;

a first pump connected to said first port communicating with said first passage and producing a maximum pressure;

a first check valve communicating the second port with the second passage and allowing fluid flow from the first passage to the second port and passage;

a second check valve communicating the third port with the third passage and allowing fluid flow from the first passage to the third port and passage;

a third check valve allowing fluid flow from the third passage to the fourth passage;

a fourth check valve communicating the fourth port with the fourth passage and allowing fluid flow from the second passage to the fourth port and passage wherein said fourth check valve is substantially the same structurally and dimensionally as said second check valve such that said driving pressure may be maintained at a substantially constant predetermined level;

a first variable reducing valve communicating with said second and fourth check valves and including means for producing a variable pressure less than said maximum pressure by controlling blocking force of said second and fourth check valves against said first and second passages, respectively;

a second variable reducing valve communicating with said first and third check valves and including means for producing a variable pressure less than said maximum pressure by controlling a blocking force of said first and third check valves against said first and third passages, respectively; and a second pump for delivering a pressurized fluid to said first and second variable reducing valves;

a rotary actuator connected to said second and third ports and operable to rotate said rotary body;

a fifth passage formed in said control valve assembly, said control circuit further comprising a fluid storage tank and a fifth check valve, said fifth check valve being disposed in said fifth passage communicating with said fourth port, biased closed by means, and having an opening facing said fourth port such that said fluid flows from said fourth port through said fifth check valve and into said tank; and a first auxiliary passage connecting said third port with said fourth passage, a check valve provided in said first auxiliary passage and having an opening facing said fourth passage, a second auxiliary passage means connecting said fourth port with said second port, and a check valve provided in said second auxiliary passage and having an opening facing said fourth port.

* * * * *

UNITED STATES PATENT AND TRADEMARK OFFICE

CERTIFICATE OF CORRECTION

PATENT NO. : 4,362,018

DATED : December 7, 1982

INVENTOR(S) : SATORU TORII

It is certified that error appears in the above—identified patent and that said Letters Patent is hereby corrected as shown below:

In column 3, line 35, delete "an" before "auxiliary" and insert therefor --a first--;

In column 3, line 37, delete "a first" and insert therefor --an--;

In column 4, line 23, delete "41" and insert therefor --14--;

In column 6, line 5, delete "5" and insert therefor --is--;

In column 8, line 17, delete "and" after "respectively;".

Signed and Sealed this

Second Day of August 1983

[SEAL]

Attest:

GERALD J. MOSSINGHOFF

Attesting Officer

Commissioner of Patents and Trademarks